US006186151B1

(12) United States Patent
Newlin

(10) Patent No.: US 6,186,151 B1
(45) Date of Patent: Feb. 13, 2001

(54) APPARATUS FOR GROOMING AND DECORATING HAIR

(76) Inventor: Diana Newlin, 4073 Walnut Blvd., Walnut Creek, CA (US) 94596

( * ) Notice: Under 35 U.S.C. 154(b), the term of this patent shall be extended for 0 days.

(21) Appl. No.: 09/376,688

(22) Filed: Aug. 18, 1999

(51) Int. Cl.[7] ..... A45D 8/04; A45D 8/00; A45D 8/20; A45D 8/22

(52) U.S. Cl. ..... 132/273; 132/276; 132/277; 132/278

(58) Field of Search ..... 132/273, 275, 132/276, 277, 278, 144, 145, 146, 148, 201, 54

(56) References Cited

U.S. PATENT DOCUMENTS

| | | | | |
|---|---|---|---|---|
| 794,479 | * | 7/1905 | Austin | 132/278 |
| 2,165,716 | | 7/1939 | Molleson | 132/278 |
| 2,651,310 | | 9/1953 | Selson | 132/278 |
| 3,280,826 | | 10/1966 | Jenkins | 132/278 |
| 3,645,278 | * | 2/1972 | Abraham | 132/278 |
| 4,830,029 | | 5/1989 | Bird | 132/54 |
| 5,501,239 | | 3/1996 | Walker | 132/275 |
| 5,533,533 | * | 7/1996 | Shing | 132/279 |
| 5,638,836 | * | 6/1997 | Yasuda | 132/279 |
| 5,694,956 | * | 12/1997 | Grinszpan | 132/275 |
| 5,813,418 | | 9/1998 | Pillars | 132/201 |
| 5,816,267 | * | 10/1998 | Chou | 132/145 |
| 5,896,862 | * | 4/1999 | Hwang | 132/145 |

* cited by examiner

*Primary Examiner*—John J. Wilson
*Assistant Examiner*—Robyn Kieu Doan
(74) *Attorney, Agent, or Firm*—Thomas R. Lampe

(57) ABSTRACT

Apparatus for grooming and decorating hair includes a hair clip and a grooming device pivotally connected to the hair clip. The grooming device can be moved between a position between the jaws of the hair clip and a position exterior of the hair clip and projecting outwardly from the jaws.

14 Claims, 3 Drawing Sheets

APPARATUS FOR GROOMING AND DECORATING HAIR

TECHNICAL FIELD

This invention relates to apparatus for grooming and decorating hair. More particularly, the apparatus can be attached to an individual's hair to augment or style the hair or employed to groom the individual's hair when removed therefrom.

BACKGROUND OF THE INVENTION

Decorative clips for hair are well known and the clips come in a wide variety of shapes and sizes.

U.S. Pat. No. 5,501,239, issued Mar. 26, 1996, illustrates a clip comprising a pair of jaws having a mutual pivotal connection. The jaws of the clip are provided with a spring which urges the jaws into engagement. A hair piece is connected to the clip.

The following patents also disclose hair pieces and approaches for attaching them to an individual's hair: U.S. Pat. No. 3,280,826, issued Oct. 25, 1996, U.S. Pat. No. 4,830,029, issued May 16, 1989, U.S. Pat. No. 5,813,418, issued Sep. 29, 1998, U.S. Pat. No. 2,165,716, issued Jul. 11, 1939, and U.S. Pat. No. 2,651,310, issued Sep. 8, 1953.

All of the above-identified patents have in common the fact that they disclose devices for enhancing the appearance of or decorate the hair of the wearer. The devices are not suitable for performing the function of grooming an individual's hair.

DISCLOSURE OF INVENTION

The present invention relates to apparatus of relatively simple, inexpensive construction which is readily adaptable to either groom an individual's hair or decorate the hair.

The apparatus includes a hair clip for selective attachment to an individual's hair. A grooming device is connected to the hair clip, the grooming device for grooming the hair of an individual when the hair clip is not attached to the individual's hair.

The hair clip includes a pair of pivotally interconnected jaws defining a clip interior and means for opening and closing the jaws. The grooming device is selectively movable between a first position wherein the grooming device is located between the jaws and a second position wherein the grooming device is disposed exterior of the hair clip and projects outwardly from the jaws.

Other features, advantages, and objects of the present invention will become apparent with reference to the following description and accompanying drawings.

MODES FOR CARRYING OUT THE INVENTION

Referring now to FIGS. 1–9, a preferred form of apparatus constructed in accordance with the teachings of the present invention is illustrated. The apparatus includes a hair clip 10 and a grooming device in the form of an elongated brush 12

Hair clip 10 includes jaws 14 and 16, each having a plurality of gripper teeth 18.

Figure 1:
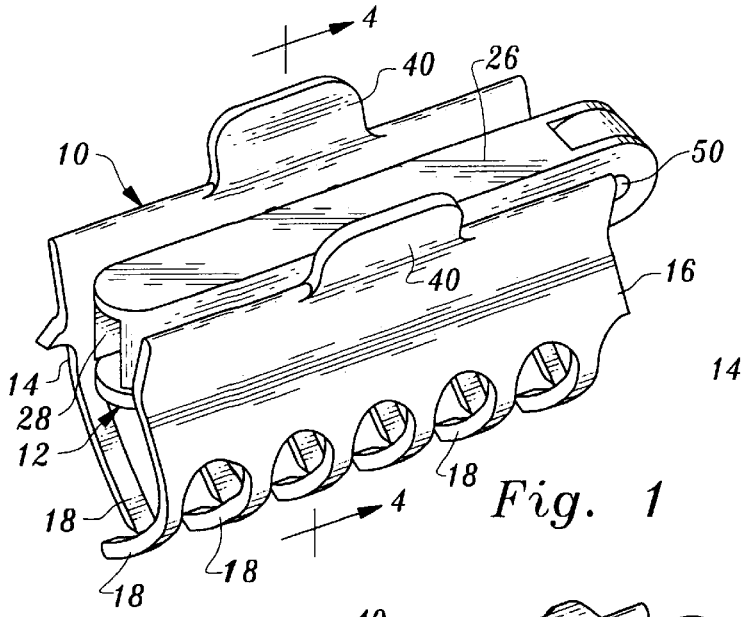
FIG. 1 is a perspective view of apparatus constructed in accordance with the teachings of the present invention with the jaws of the hair clip thereof closed and a grooming device in the form of a brush folded out of sight between the jaws.
Figure 4:
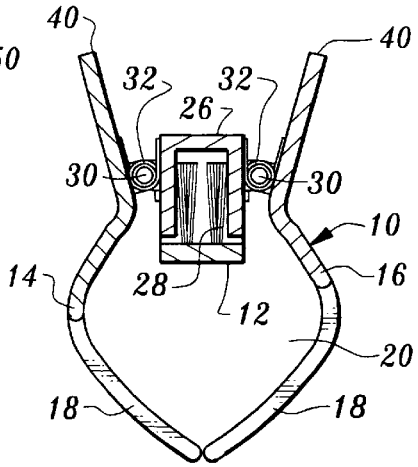
FIG. 4 is an enlarged, cross-sectional view taken along the line 4—4 in FIG. 1.
Figure 2:
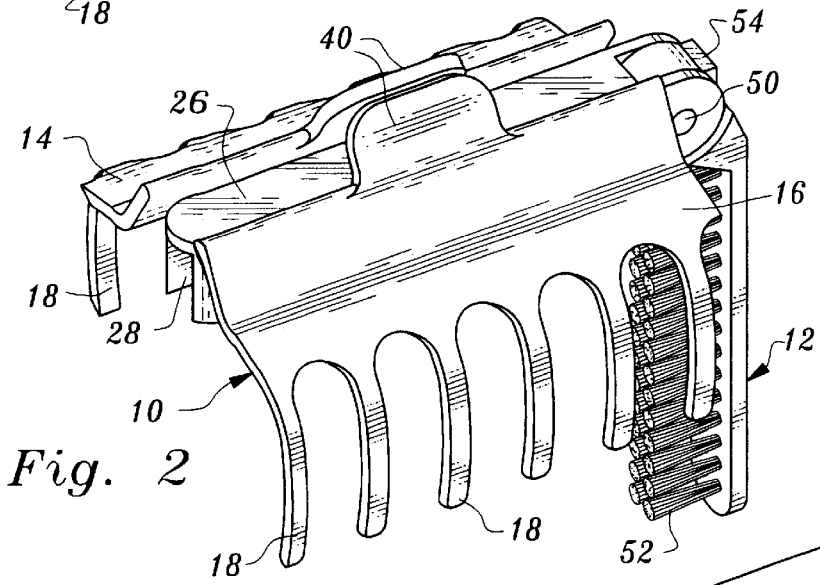
FIG. 2 is a view similar to FIG. 1, with portions thereof broken away, illustrating the jaws of the hair clip open and the brush in the process of being moved to a position wherein it can be employed to groom hair.
Figure 9:
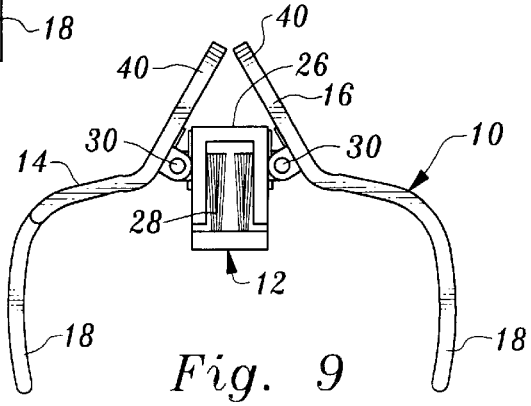
FIG. 9 is a view similar to FIG. 7 but illustrating the jaws opened.

The jaws curve as shown and the jaws are movable between a closed condition (shown in FIGS. 1 and 3, for example) and an open position (shown in FIGS. 2 and 9, for example). The jaws define a clip interior 20 (FIG. 4).

When the jaws are open the distal clamping ends of the jaws (the distal ends of gripper teeth 18) form a space sufficiently large to enable passage of brush 12 therethrough. This is illustrated quite clearly in FIG. 2, for example. When, however, the jaws are closed, movement of the brush between the positions of FIG. 1 and FIG. 3 is prevented.

Located between jaws 14, 16 is a housing 26 defining a housing opening 28. The jaws 14, 16 are pivotally connected to opposed sides of housing 26 by a pivot connection 30. Springs 32 disposed at the pivot connections bias the jaws 14, 16 closed. Projections 40 on the jaws are manually pressed together by the user of the apparatus to overcome the bias of springs 32 and temporarily move the jaws to open position.

The brush 12 is pivotally connected at one end thereof to housing 26 of the hair clip by a pivot pin 50. When the brush 12 is in the position shown in FIGS. 1 and 4, for example, the bristles of the brush extend through housing opening 28 and into the interior of the housing. Thus the bristles are protected and concealed when an individual wishes to utilize the apparatus as a hair decoration.

Figure 3:
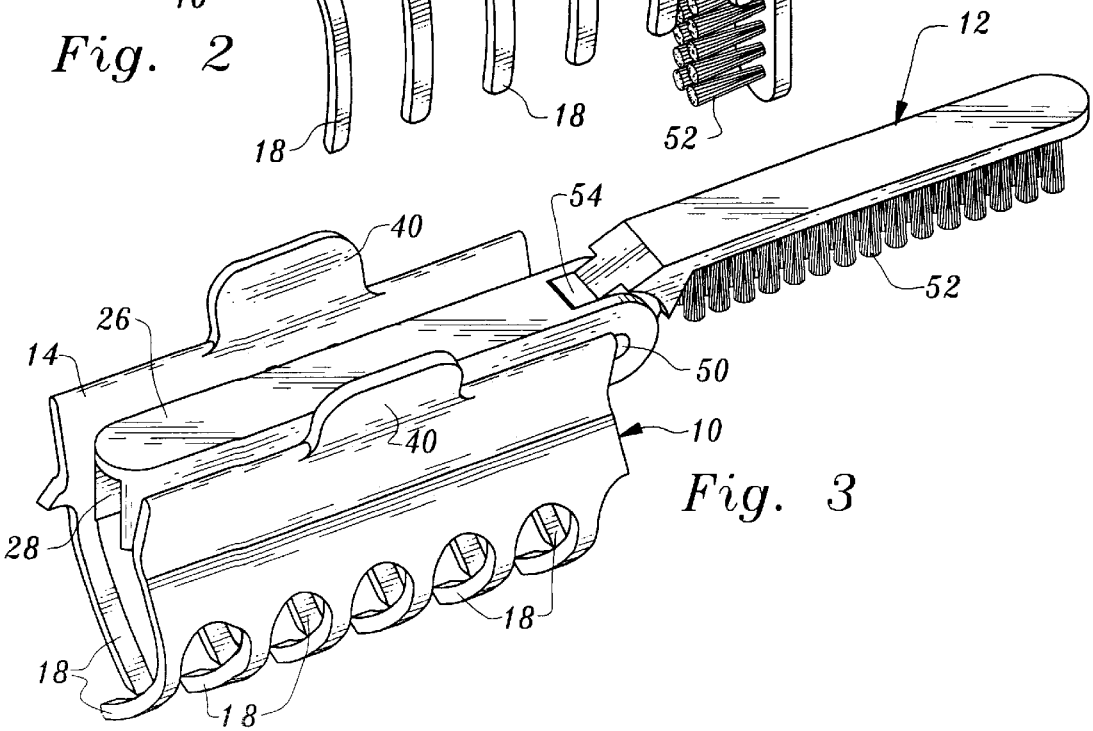
FIG. 3 is a view similar to FIG. 1 but illustrating the brush in grooming position wherein it is disposed exterior of the hair clip and projects outwardly from the jaws.
Figure 5:
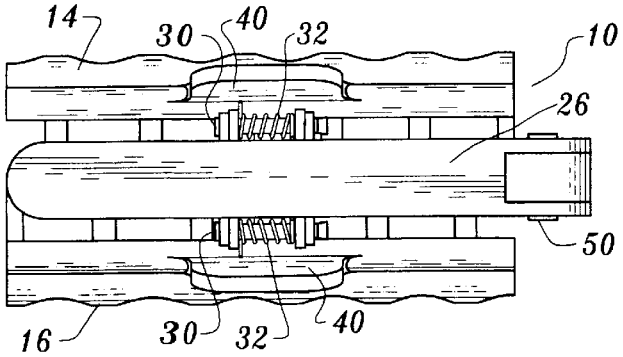
FIG. 5 is a top, plan view of the apparatus in the condition shown in FIG. 1, portions of the hair clip broken away.
Figure 6:
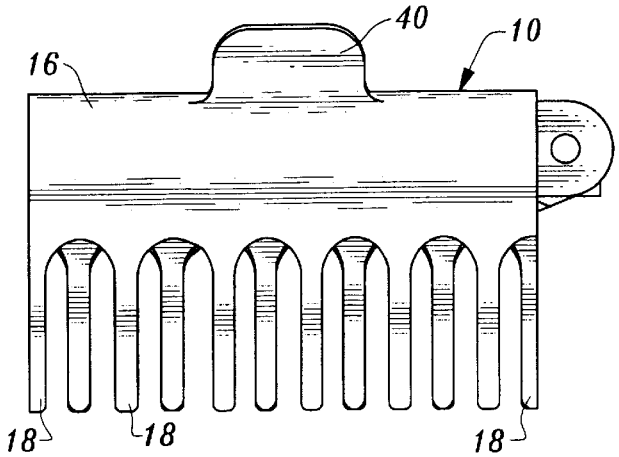
FIG. 6 is a side, elevational view of the apparatus in the condition shown in FIG. 1.
Figure 7:
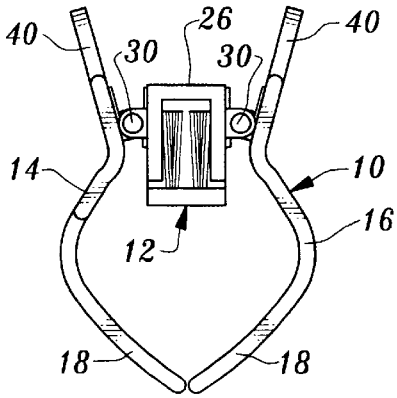
FIG. 7 is an elevational, end view of the apparatus in the condition shown in FIG. 1, the jaws being closed.
Figure 8:
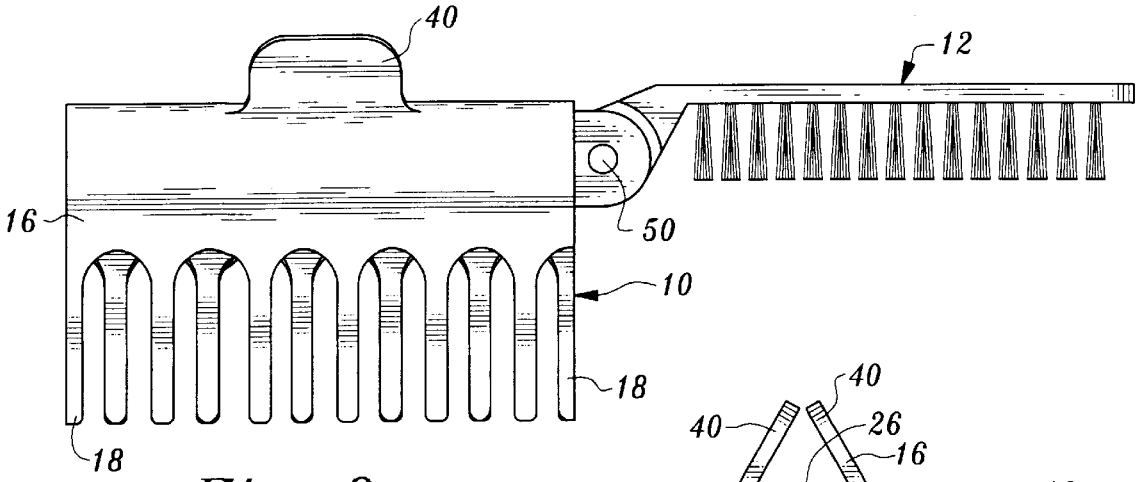
FIG. 8 is a view similar to FIG. 6 but illustrating the apparatus in the condition of FIG. 3.

When it is desired to use the brush, the jaws are opened and the brush swung downwardly and away from the jaws about pivot pin 50 until the brush reaches the position shown in FIG. 3. A protrusion 54 on the brush engages the housing 26 when the brush is in the position shown in FIG. 3 to prevent further movement of the brush. After the brush has been used to groom the hair it can readily be returned to its initial position of FIG. 1 by again opening the jaws and swinging the brush in a clockwise direction (as viewed in FIG. 2). The grooming device pivotally moves in a direction orthogonal to the direction of movement of the pivotally interconnected jaws.

Figure 10:
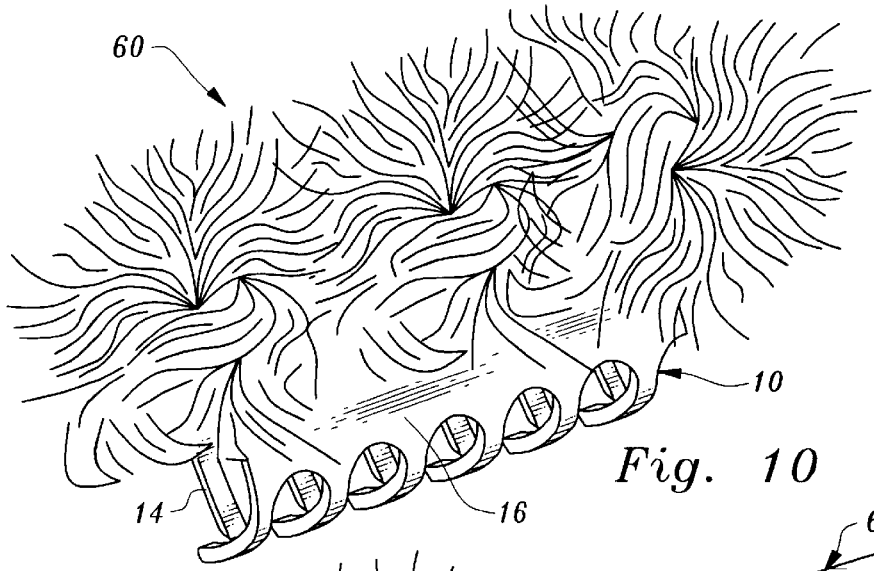
FIG. 10 is a perspective view of a second embodiment of the apparatus with the grooming device within the confines of the hair clip.
Figure 11:
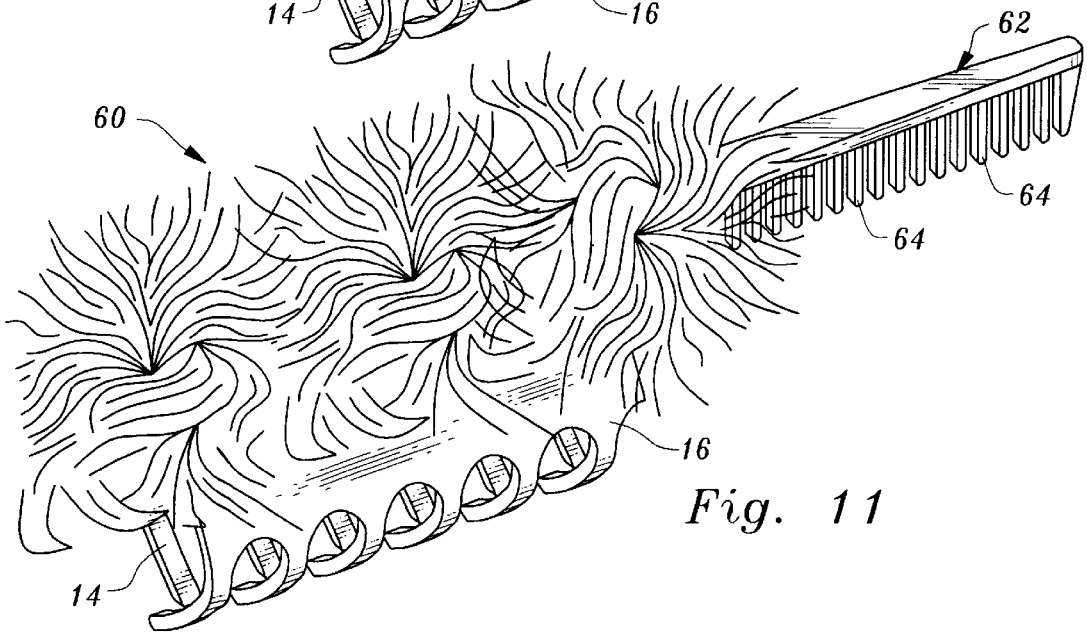
FIG. 11 is a perspective view of the second embodiment illustrating a grooming device in the form of a comb in extended position for grooming hair.
Figure 12:
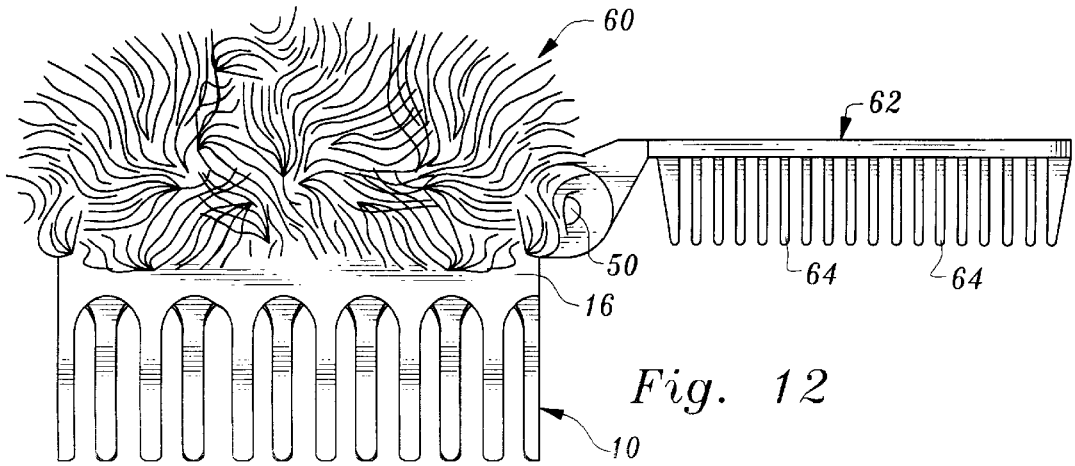
FIG. 12 is a side, elevational view of the second embodiment of the invention in the condition illustrated in FIG. 11.

FIGS. 10–12 illustrate an alternative embodiment of the invention which includes hair clip 10. In this embodiment a hair piece 60, formed of either natural or artificial hair is attached in any suitable manner to the hair clip and hides the top of the hair clip including the housing thereof. Also in this embodiment, the grooming device is in the form of a comb 62 having teeth 64. FIG. 10 illustrates the apparatus with the comb hidden between the jaws 14, 16 of the hair clip. In FIGS. 11 and 12 the comb is shown fully extended for hair grooming use.

Ribbons or other decorative items can be attached to the hair clip.

What is claimed is:

1. Apparatus for grooming and decorating hair, said apparatus comprising, in combination:

a hair clip for selective attachment to an individual's hair;

a grooming device; and connector means connecting said grooming device to said hair clip, said grooming device for grooming the hair of an individual when said hair clip is not attached to the individual's hair, said hair clip including a pair of pivotally interconnected jaws defining a clip interior and means for opening and closing said jaws, said grooming device being selectively movable between a first position wherein said grooming device is located between said jaws and a second position wherein said grooming device is disposed exterior of said hair clip and projects outwardly from said jaws, each jaw having a distal clamping end, and said distal clamping ends of said jaws comprising a plurality of teeth relatively movable to form a space when said jaws are opened sufficiently large to enable passage of said grooming device between said distal clamping ends when said grooming device moves between said first and second positions.

2. The apparatus according to claim 1 wherein said grooming device is pivotally connected to said hair clip by said connector means.

3. The apparatus according to claim 2 wherein said grooming device comprises a comb pivotally connected to said hair clip by said connector means.

4. The apparatus according to claim 2 wherein said grooming device comprises a brush pivotally connected to said hair clip by said connector means.

5. The apparatus according to claim 1 wherein said means for opening and closing said jaws includes biasing means biasing said jaws closed and manually engageable elements on said jaws spaced from said biasing means for opening said jaws against the bias exerted by said biasing means.

6. The apparatus according to claim 1 additionally comprising a hair piece attached to said hair clip, said hair piece at least partially covering and concealing said hair clip.

7. The apparatus according to claim 1 wherein said hair clip additionally comprises a housing defining a housing opening located between said jaws, said housing opening communicating with said clip interior and accommodating said grooming device when said grooming device is in said first position.

8. The apparatus according to claim 1 additionally comprising a first biasing spring interconnecting one of said jaws to said housing and a second biasing spring interconnecting the other of said jaws to said housing.

9. The apparatus according to claim 8 wherein said first and second biasing springs are positioned on opposed sides of said housing.

10. The apparatus according to claim 1 additionally comprising means restricting movement of said grooming device relative to said hair clip.

11. The apparatus according to claim 2 wherein said grooming device pivotally moves in a direction orthogonal to the direction of movement of said pivotally interconnected jaws.

12. The apparatus according to claim 1 wherein each jaw has a distal clamping end, said distal clamping ends of said jaws relatively movable to form a space when said jaws are opened sufficiently large to enable passage of said grooming device between said distal clamping ends when said grooming device moves between said first and second positions.

13. The apparatus according to claim 12 wherein said distal clamping ends comprise a plurality of teeth.

14. Apparatus for grooming and decorating hair, said apparatus comprising, in combination:

a hair clip for selective attachment to an individual's hair;

a grooming device;

connector means connecting said grooming device to said hair clip, said grooming device for grooming the hair of an individual when said hair clip is not attached to the individual's hair, said hair clip including a pair of pivotally interconnected jaws defining a clip interior and means for opening and closing said jaws, said grooming device being selectively movable between a first position wherein said grooming device is located between said jaws and a second position wherein said grooming device is disposed exterior of said hair clip and projects outwardly from said jaws;

a housing defining a housing opening located between said jaws, said housing opening communicating with said clip interior and accommodating said grooming device when said grooming device is in said first position; and a first biasing spring interconnecting one of said jaws to said housing and a second biasing spring interconnecting the other of said jaws to said housing.

* * * * *